US005325967A

United States Patent [19]

Gonzales

[11] Patent Number: 5,325,967

[45] Date of Patent: Jul. 5, 1994

[54] PACKAGING DEVICE USING MEMBRANE, PLATFORM AND APERTURE AS A MEANS OF RESTRAINT

[76] Inventor: Juanita A. Gonzales, P.O. Box 60131, Palo Alto, Calif. 94306-0131

[21] Appl. No.: 890,651

[22] Filed: May 28, 1992

[51] Int. Cl.[5] ..... B65D 85/30; B65D 73/00

[52] U.S. Cl. ..... 206/462; 206/466; 206/478; 206/495; 206/591; 206/594

[58] Field of Search ..... 206/461, 462, 466, 477, 206/478, 479, 483, 495, 521, 583, 588, 589, 590, 591, 593

[56] References Cited

U.S. PATENT DOCUMENTS

| | | | |
|---|---|---|---|
| 539,554 | 5/1895 | Smith | 206/478 |
| 1,124,438 | 1/1915 | Holton | 206/583 X |
| 1,185,709 | 6/1916 | Penn | 206/583 X |
| 1,877,840 | 9/1932 | Frowenfeld | 206/479 |
| 2,030,996 | 2/1936 | Lustig | 206/466 |
| 2,535,229 | 12/1950 | Paolantonio | 206/478 X |
| 2,645,340 | 7/1953 | Dow | 206/478 |
| 3,780,854 | 12/1973 | Ruppenthal | 206/495 X |
| 3,811,565 | 5/1974 | Tancredi | 206/478 |
| 3,885,667 | 5/1975 | Spiegel et al. | 206/466 X |
| 3,885,671 | 5/1975 | Spiegel et al. | 206/466 X |
| 4,523,702 | 6/1985 | Viio | 206/479 X |
| 4,852,743 | 8/1989 | Ridgeway | 206/591 X |
| 4,981,213 | 1/1991 | Dillon | 206/462 X |

FOREIGN PATENT DOCUMENTS

| | | | |
|---|---|---|---|
| 377948 | 1/1931 | United Kingdom | 206/478 |

*Primary Examiner*—Paul T. Sewell
*Assistant Examiner*—Jacob K. Ackun, Jr.

[57] ABSTRACT

A packaging device formed of substantially rigid material, comprising a container, such as a cardboard carton, with a sheet of substantially rigid material, such as cardboard, fastened inside some distance above the bottom, with a perforation through the sheet, in which an article of goods to be packaged is wrapped inside of a flexible membrane, such as a plastic bag, with the free ends of the membrane drawn downwards through the perforation and pulled tightly and wrapped around at least one edge of the sheet and fastened with a staple through the membrane and the sheet of substantially rigid material which causes the goods to be held tightly against the sheet in the proximity of the perforation to protect the goods against damage due to rough handling of the container.

3 Claims, 3 Drawing Sheets

PACKAGING DEVICE USING MEMBRANE, PLATFORM AND APERTURE AS A MEANS OF RESTRAINT

BACKGROUND OF THE INVENTION

Field of the Invention

This invention relates to improvements in packaging, more particularly to a packaging system wherein goods are secured into a container without contacting the exterior sides of the container thereby helping to prevent damage to the goods if the container is dropped. One of the objects of this invention is to provide an inexpensive method to safely package a large variety of items using identical packaging for items of different size and shape. A further object of this invention is to reduce the amount of waste products generated during packaging and shipping. A further object of this invention is to provide a packaging system that can be folded flat for storage prior to and after use.

DESCRIPTION OF PRIOR ART

Heretofore packaging of small articles for shipping had relied upon methods of filling the space around the cargo with filler materials such as excelsior, straw, styrofoam, styrofoam "peanuts", popcorn etc. My unique invention forces the cargo to stay in place without filling the container with such eventual debris. This invention therefore also reduces financial and environmental costs of packaging, reduces weight for shipping and eliminates the cost of the need for disposal of the materials normally used as a filler.

Many U.S. patents have been granted for devices wherein goods are fastened with membranes, belts and filaments to inside and outside surfaces of display containers and holders of different types. For example, in #2030996 Lustig describes a display apparatus wherein the cargo of bags of candy or peanuts is wedged into serrated perforations in a semi-rigid sheet of material that converts from being the face of a display into an exterior wall of a carton. Smith in #539554 uses a simple holder fastened upon the outside wall of a container to display merchandise. #3811565 uses a reinforcing band to fasten the cargo of the doll to the inside face of an exterior wall of a display box. In #4523702 one or more straps are used with perforations or slots to fasten cargo of tools to an exterior face of a tool holder. Paolantonio in #2535229 uses a frangible cover over a display card of knives wherein the knives are held by elastic straps against the card while a sheet of the frangible material is also held against the card by the elastic. #3780854 uses baling strands to hold stored paper against a substantially rigid board member while Speigel et al., uses a heat shrunk tube to hold cargo to a display card in #3885671 and #3885667. Frowenfeld in #1877840 uses string to hold articles to a display card. In #4981213 Dillon uses elastic members to hold articles to a support panel and Wang in foreign patent #377948 uses press buttons to secure bands holding articles to a display card. While these inventions may display or store articles well, none of them offer any protection to the articles if the invention is dropped with the articles on the impact side of the container.

There is a definite need for an inexpensive, simple packaging device which does not rely upon fillers and eliminates other shortcomings of previous methods. The global enviroment is being inunduated daily with debris and much of this debris was originally used as packaging material. This invention will reduce a substantial portion of that debris.

SUMMARY OF THE INVENTION

An inexpensive packaging invention of a container, preferably a cardboard carton, with a load bearing platform, preferably of cardboard, supported more than one-half inch above the designated floor of the carton. The platform was a perforation smaller than the article of goods to be packaged located at the geometric center of the platform. The article of goods to be packaged is enrobed in a flexible membrane and the ends of the membranes are bunched together, drawn downward through the aperture in the platform with enough tension to draw the article of goods firmly against the platform and fastened to the platform in any manner. If the container is dropped the goods will be protected from damage by being held away from the sides of the container.

Another embodiment of this invention uses a plurality of apertures wherein corners or other parts of the membrane are drawn through different apertures for fastening different cargo shapes.

Another embodiment of this invention is one in which said membrane is drawn through said aperture and then brought to the front edge and fastened to this front edge of said platform using a metal staple to fasten said membrane.

Another embodiment of this invention has the platform in a vertical or other non-horizontal position.

Another embodiment of this invention uses a spring powered clipping or holding mechanism to prevent the membrane from being drawn back through the aperture.

Another embodiment of this invention uses a heat source to tighten the membrane after the membrane is fastened to the platform.

This unique and yet extremely simple and inexpensive packaging invention may be the most innovative advance in packaging in many years. Even the long term effects of the enviroment of the decreasing use of filler materials may be considered a substantial effect of this invention.

DESCRIPTION OF A PREFERRED EMBODIMENT

Figure 1:
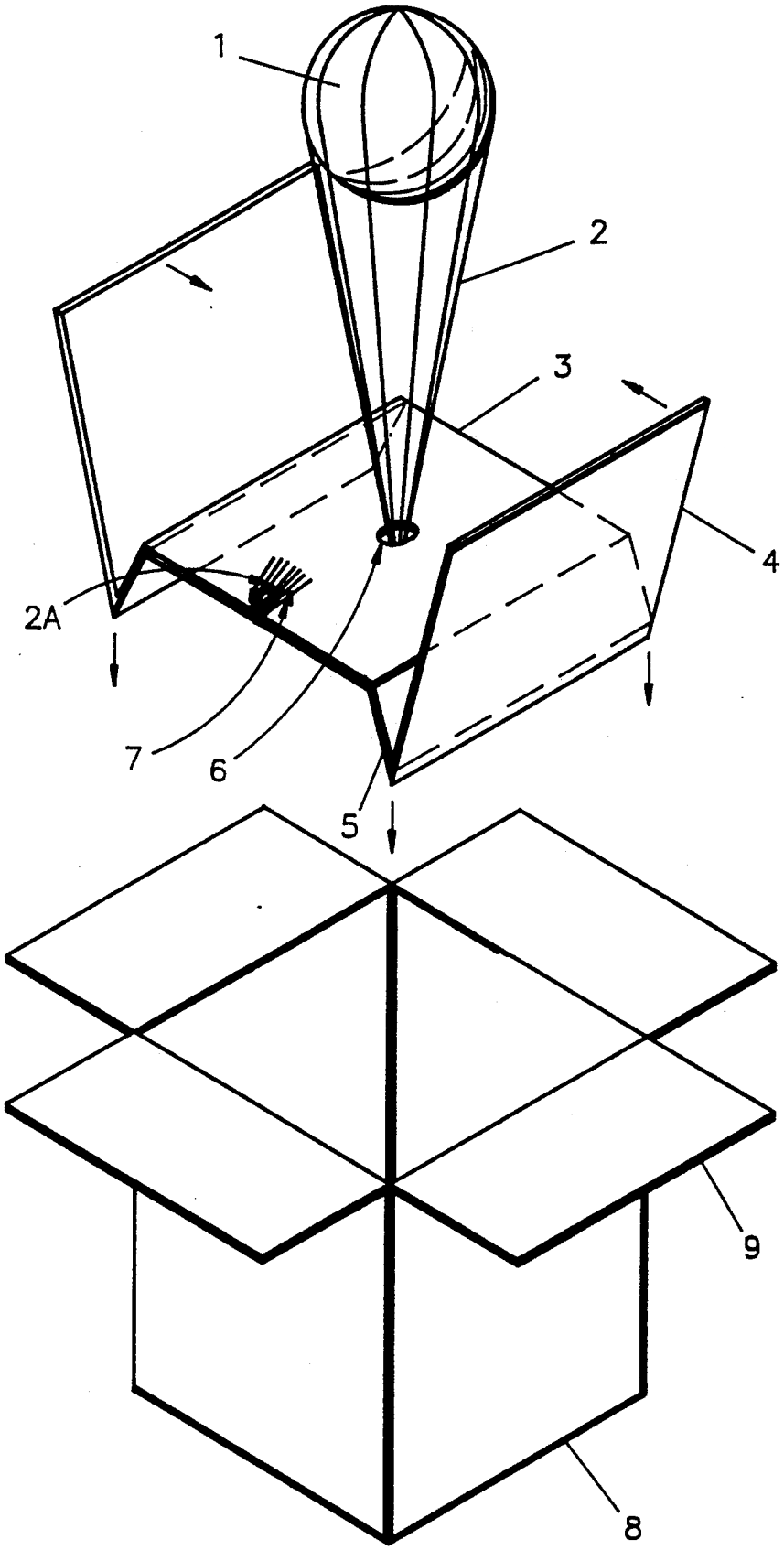
FIG. 1 shows a perspective view of an embodiment of this invention with one article of cargo inserted into one membrane and supported by one platform with the entire assembly lowered into one carton.
Figure 2:
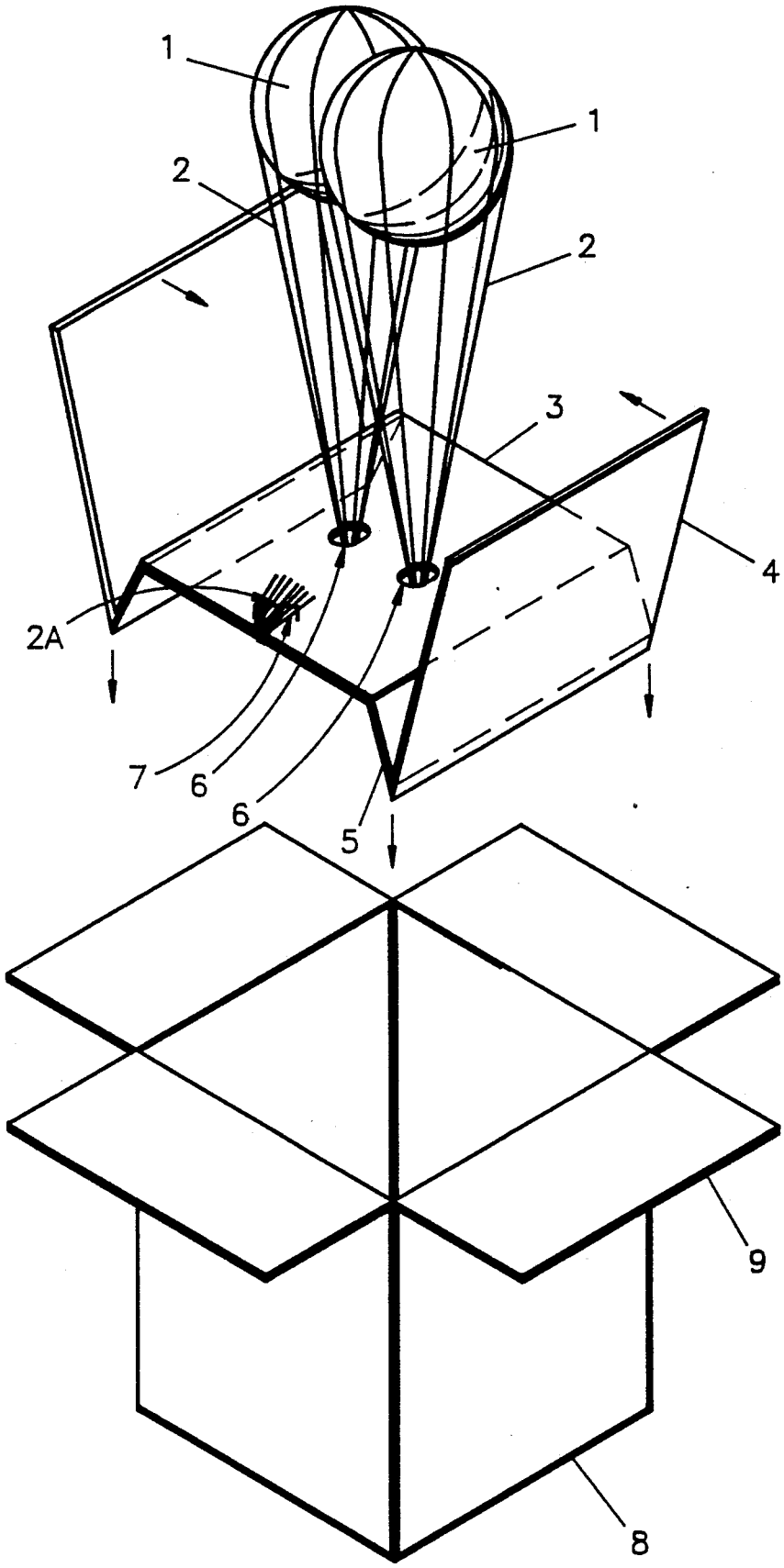
FIG. 2 shows a perspective view of an embodiment of this invention with two articles of cargo contained one each in two separate membranes and each membrane is inserted through one of two separate apertures in the same platform with the entire assembly lowered into one carton.
Figure 3:
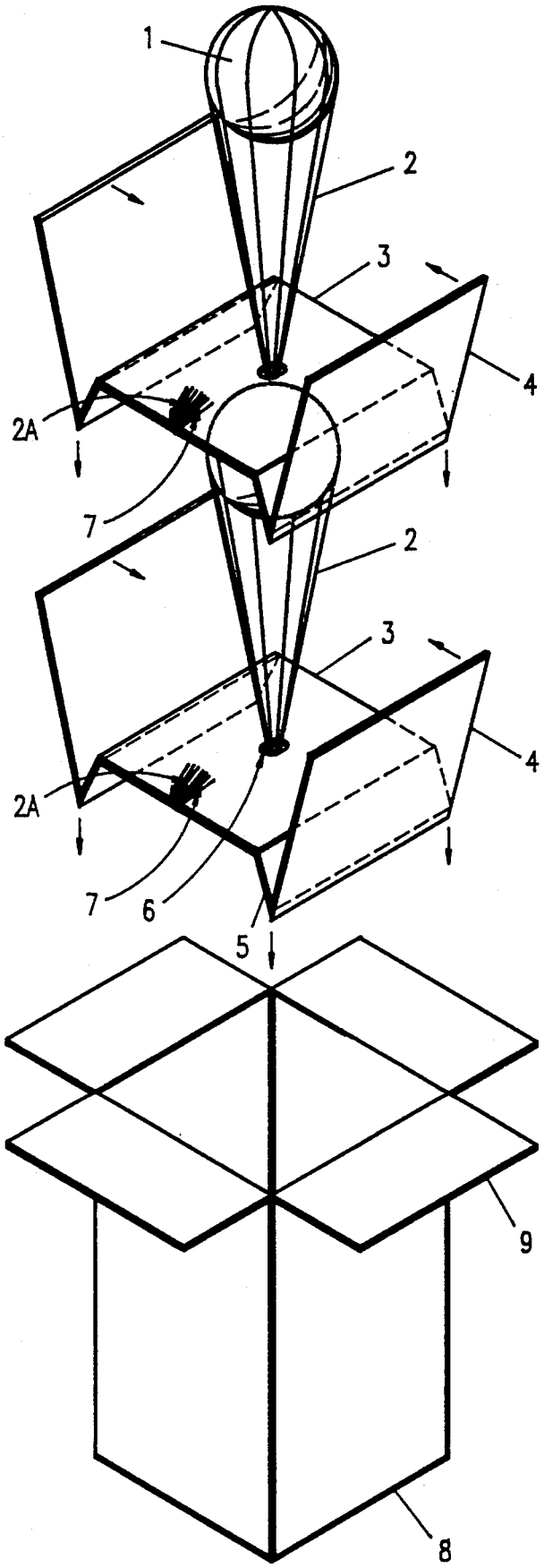
FIG. 3 shows a perspective view of an embodiment of this invention with two articles of cargo inserted one each into two separate membranes with each membrane inserted into an aperture in one of two separate platforms with the entire assembly lowered into one carton.

In FIG. 1 of the drawing a conventional corrugated cardboard carton 8 is illustrated in which one end of the carton 8 is open and designated as the top and the rest of the carton 8 is conventionally sealed. The four carton flaps 9 are shown in the open position. A piece of conventional cardboard is used as a shelf or platform 3 that is of a size to fit snugly into the carton 8 when inserted parallel to the bottom and top of the carton 8. Two corrugated cardboard supporting tabs 5 are shown attached to the platform 3. These two supporting tabs 5 are each attached to an opposite edge of the platform 3 and angled downward at a ninety degrees from the platform. The purpose of these supporting tabs 5 is to support platform 3 a distance equal to the supporting tabs 5 shorter dimension above the floor of the carton 8. These two supporting tabs 5 can be of any shape and size that will fit into the carton 8 since their shape and size is not critical but in this preferred embodiment the supporting tabs 5 shown are rectangular with a longer dimension equal to the length of the edge of the platform 3 to which they are attached and with this longer edge used as the edge that attaches to the platform 3 and of a shorter dimension equal to one-sixth of their longer dimension. These two supporting tabs 5 can be attached to the platform 3 in any manner whatever bit in this preferred embodiment they were originally part of a sheet of cardboard stock that the platform 3 was made from and they were formed by one face of the cardboard stock, which will eventually form the upper face of the supporting platform 3, being scored along the two lines that mark the two opposite edges of the platform 3 that attach to the supporting tabs 5 and then the supporting tabs 5 are created by the cardboard being bent downward at a ninety degree angle and thus these two supporting tabs 5 are fastened to the platform 3 by the lower skin of the platform 3 bending downward at ninety degrees and continuing as the adjacent skin of the supporting tabs 5. Two corrugated cardboard positioning tabs 4 are shown with each one attached to one of the supporting tabs 5. The purpose of these positioning tabs 4 is to hold the supporting tabs 5 in a certain position inside of the carton. In this preferred embodiment the supporting tabs 5 are held in position parallel to two sides of and against the bottom of the carton 8. These two positioning tabs 4 are rectangular in shape and of the size required for them to fit snugly into the carton 8 when both are inserted parallel to the same two sides of the carton that the supporting tabs 5 are parallel to and the carton flaps 9 are closed. Each of these two positioning tabs 4 is fastened to a separate one of the supporting tabs 5 with the entire face surface of each supporting tab 5 that faces the exterior of the carton 8, when attached as described above to the platform 3 and angled downward at ninety degrees, contacting against one face surface of one of the positioning tabs 4 and fastened together in any manner whatever. In this preferred embodiment, however, each of the two positioning tabs 4 is created out of the same piece of cardboard stock as the platform 3 is created from by having the cardboard stock scored on the same face which will eventually form the lower face of the platform 3, along the two straight lines that would designated the longer edge of each supporting tab 5 opposite the edge attached to the platform 3, and then the positioning tabs 4 are created by bending the cardboard stock away from these two scored lines one hundred and eighty degrees and thus bringing the face of each positioning tab 4 that will face towards the platform 3 flush against the face of one supporting tab 5 that will face away from the platform 3. Thus each of the two positioning tabs 4 are attached to one of the two supporting tabs 5 by having the skin of the faces that is to be folded flush to each other be of the same continuous skin of cardboard bent one hundred and eighty degrees at their common edge, thereby stopping movement with respect to each other in a parallel plane. In this preferred embodiment when the platform 3 is inserted into the carton 8 as described above with the two supporting tabs 5 fastened and bent at ninety degrees downward as described above and the two positioning tabs 4 are fastened to the two supporting tabs 5 and bent upward at one hundred and eighty degrees as described above, the assembly can be slid down into the carton 8 from above. A article of goods 1 is enrobed by a membrane 2 and the loose ends of the membrane 2 are bunched together and inserted downward through an aperture 6 in the platform 3, pulled through the aperture until the cargo is snugly held against the platform 3 whereupon the bunched ends of the membrane 2 are pulled up and over either edge of the platform 3 that is not encumbered by a supporting tab 5 and a common metal staple 2*a* is stapled through both the bunched membrane 2 and the platform 3. Whereupon the entire assembly including cargo 1 is lowered into the carton 8 and the flaps 9 are closed and sealed.

I claim:

1. A package for holding at least one object safe from damage due to rough handling of the package, comprising:

a cardboard carton having a bottom and sidewalls extending upwardly therefrom, a load bearing supporting sheet fastened within said carton a distance above the bottom of said carton and comprising at least one edge, first and second surfaces, and an aperture therethrough, said at least one object positioned on the first surface of said supporting sheet in alignment with said aperture and held tightly thereon by a flexible membrane, first portions of said flexible membrane extending about and tightly enveloping said at least one object, second portions of said flexible membrane extending through said aperture and along the second surface of said supporting sheet, and free ends of said flexible membrane being fastened to an edge of said supporting sheet by a metal staple extending through said free ends of said flexible membrane and said edge of said supporting sheet thereby preventing said at least one object from moving in relation to said supporting sheet and thereby protecting said at least one object from damage.

2. A package as in claim 1 further comprising a plurality of load bearing supporting sheets fastened within said carton, each supporting sheet having at least one object held tightly thereon by a flexible membrane.

3. A package as in claim 1 further comprising a plurality of apertures in said supporting sheets, and a plurality of membranes each tightly holding at least one object on said supporting sheet, each one of said plurality of membranes extending through one of said aperture to hold said at least one object to said supporting sheet.

* * * * *